United States Patent [19]

Logan, Jr.

[11] 4,314,722

[45] Feb. 9, 1982

[54] TIMING APPARATUS FOR DELAYING OPENING OF DOORS

[75] Inventor: Emanuel L. Logan, Jr., Silver Spring, Md.

[73] Assignee: Reliable Security Systems, Inc., Cockeysville, Md.

[21] Appl. No.: 89,398

[22] Filed: Oct. 30, 1979

Related U.S. Application Data

[63] Continuation-in-part of Ser. No. 65,491, Aug. 20, 1979.

[51] Int. Cl.[3] ..... E05C 17/32

[52] U.S. Cl. ..... 292/263; 292/92

[58] Field of Search ..... 292/263, 144, 201, 21, 292/92, DIG. 66; 16/84, 51, 82, 49; 70/268, 269

[56] References Cited

U.S. PATENT DOCUMENTS

| | | | |
|---|---|---|---|
| 2,588,010 | 3/1952 | Fennon | 16/55 |
| 2,851,296 | 9/1958 | Guyaz | 292/78 |
| 2,881,020 | 4/1959 | Kok | 292/78 |
| 3,309,125 | 3/1967 | Neveling | 292/78 |
| 3,383,130 | 5/1968 | De Avila | 292/92 |
| 3,435,643 | 4/1969 | Pollak et al. | 70/92 |
| 3,583,740 | 6/1971 | Armstrong | 292/198 |
| 3,677,043 | 7/1972 | Cox | 70/92 |
| 3,796,451 | 3/1974 | Schultz | 292/263 |
| 3,970,339 | 7/1976 | Haselton et al. | 292/227 |
| 4,006,471 | 2/1977 | Pappas | 340/274 R |
| 4,050,114 | 9/1977 | Zunkel | 16/51 X |
| 4,069,544 | 1/1978 | D'Hooge | 292/263 X |

FOREIGN PATENT DOCUMENTS

| | | |
|---|---|---|
| 1130325 | 5/1962 | Fed. Rep. of Germany . |
| 2403756[U] | 2/1974 | Fed. Rep. of Germany . |
| 304335 | 1/1955 | Switzerland . |

*Primary Examiner*—Richard E. Moore

*Attorney, Agent, or Firm*—John R. Moses

[57] ABSTRACT

Opening of a door, such as an emergency exit door, is delayed by a door check, the operation of which has been reversed to delay opening of the door instead of delaying closing of the door. The delay is accomplished by a circuit which includes a normally open valve held closed by a solenoid. When the solenoid is de-energized, the circuit is opened allowing the reversed door check to operate so that the door can be opened. The solenoid is controlled by an electrical timing circuit which is started by a switch connected to a door operator such as a push bar.

7 Claims, 2 Drawing Figures

TIMING APPARATUS FOR DELAYING OPENING OF DOORS

PARENT PATENT APPLICATION

This application is a continuation-in-part of U.S. Patent Application Ser. No. 065,491 filed Aug. 20, 1979, in the name of Emanuel L. Logan, Jr.

RELATED PENDING PATENT APPLICATIONS

| APPLICATION | SERIAL NUMBER | FILED |
|---|---|---|
| EMERGENCY EXIT DOOR LATCH | 929,968 | 3/3/79 |
| EMERGENCY EXIT DOOR LOCKING AND LOCKING APPARATUS | 22,110 | 8/1/78 |
| MAGNETIC EMERGENCY EXIT DOOR LOCK SYSTEM | 051,724 | 6/25/79 |

BACKGROUND OF THE INVENTION

1. Field of the Invention

The instant invention relates to an emergency exit door security system, and more particularly, the instant invention relates to an emergency exit door security system wherein the system includes electrical circuitry for delaying transition of the system from a securred mode to an unsecurred mode while an alarm is sounding to give notice that the door is being opened without authorization.

2. Technical Considerations and Prior Art

As explained in the aforecited co-pending U.S. patent applications, there is a need for a new type of emergency exit door lock or system in which opening of the lock is delayed. In patent applications Ser. Nos. 929,968 and 022,110, the delay is accomplished by throttling a hydraulic fluid to retard retraction of a bolt while in U.S. patent application Ser. No. 051,724, the delay is accomplished by a timer which deenergizes an electromagnet after expiration of a selected time interval initiated by attempting to open the door. In the U.S. parent patent application, Ser. No. 065,491 filed Aug. 20, 1979, an electronic timer is superimposed over a hydraulic delay circuit to provide a delay for a door lock or latch. The instant invention is directed to a modification of the aforementioned approaches in which a delaying attachment is mounted on an emergency exit door.

As indicated in the related parent applications, there is an inherent conflict between safety and security, even though these two concerns are interrelated. This conflict becomes readily apparent when one considers the problems encountered in trying to optimize the design of emergency exit doors. At least some doors in public buildings, such as schools, theaters, auditoriums, restaurants and the like must, by law, be equipped with latches or locks which can be readily opened from within the building should there be a fire or other emergency situation. These locks and latches pose a security problem since doors which can be readily opened from inside of a building allow people within the building to easily escape with stolen articles and allow people within the buildings to open the doors and admit anyone they wish into the buildings. In the minds of security personnel, the security problems caused by easily openable emergency exit doors in many instances far outweigh the dangers of fire. Consequently, emergency exit doors are frequently locked with chains or other devices. This is done primarily because security problems arise with greater frequency than fires, and must be dealt with on a day-to-day basis, whereas fires occur infrequently, and dangers of fire are therefor ignored. However, if emergency exits are locked, the results are often catastrophic when fires do occur and this, of course, causes fire departments great concern. The instant invention is an improvement over the aforementioned other approaches and helps to merge the dichotomy resulting from concerns of safety and security.

SUMMARY OF THE INVENTION

In view of the foregoing considerations, and other considerations, it is an object of the instant invention to provide a new and improved timing system for delayed opening of emergency exit doors.

In view of the aforementioned object, and other objects, the instant invention contemplates a door securing system which includes a door securing attachment operating in a first mode to keep the door closed and in a second mode to allow the door to open. The shift from the first mode to the second mode is delayed by electrical circuitry which includes an electrical switch for providing a signal which indicates that an attempt to open the door is occurring and which further includes first and second timers. The first timer provides a trigger signal after a predetermined delay in order to indicate that a serious attempt to open the door is occurring and the second timer is started by the trigger signal of the first timer and emits a second trigger signal which permits transition of the door securing attachment from the first mode to the second mode. The system also includes an alarm which is sounded when an attempt is made to open the door.

DESCRIPTION OF THE PREFERRED EMBODIMENT

Figure 1:
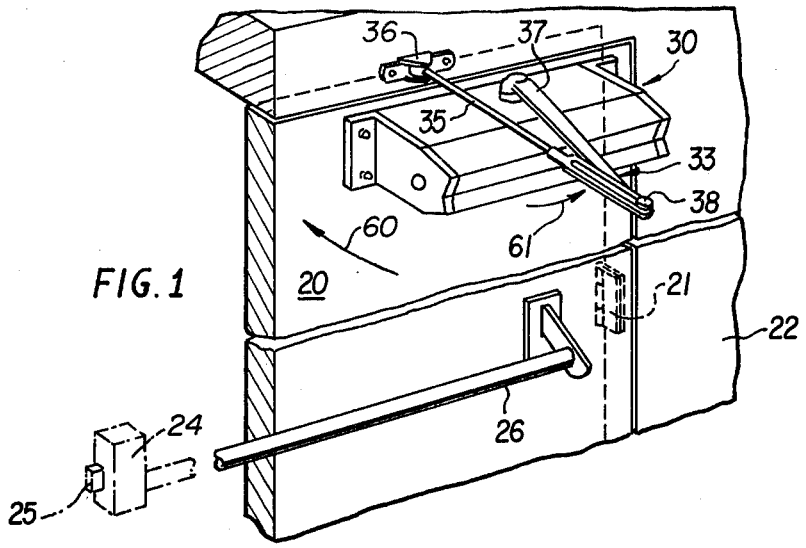
FIG. 1 is a prospective view of an emergency exit door with a hydraulic delay attachment thereon for securing the door closed within a door frame by means in addition to a projected bolt.
Figure 2:
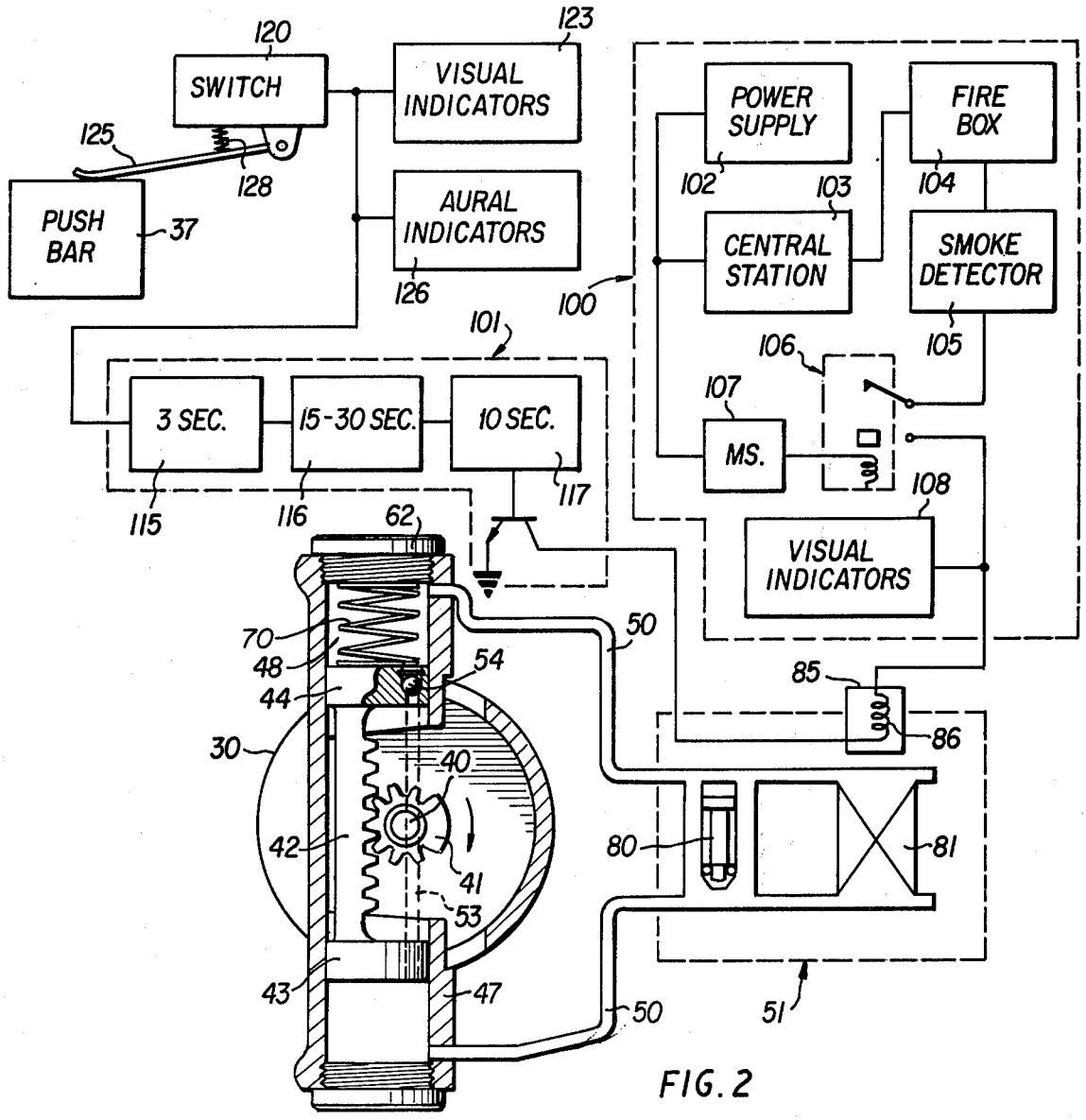
FIG. 2 is a diagrammatical view of the mechanical, hydraulic and electrical system used with the attachment to effect delayed opening of the door shown in FIG. 1.

Referring now to FIG. 1, there is shown an emergency exit door 20 mounted by hinges 21 within a door frame 22 and normally held closed by a conventional panic bar latch 24 which has a latch bolt 25 that is retracted upon pressing a panic bar 26. In accordance with the principals of the instant invention, the emergency exit door 20 has a delay attachment, designated generally by the numeral 30 secured to the upper corner thereof adjacent its hinged edge. The delay attachment 30 is generally in the form of a door check or closer wherein the delay is reversed to delay opening of the door 20 rather than to delay closing of the door.

The delay attachment 30 is connected to the door frame 22 by a linkage, designated generally by the numeral 33, which includes a first link 35 pivotally attached by pivot 36 to the door jamb 22 and a second link 37 pivoted to the first link by pivot 38 and pivoted to the delay attachment 30 by axle 40. As with the conventional door check, the axle 40 is connected to a pinion 41 that is in turn meshed with a rack 42 which has pistons 43 and 44 at opposite ends thereof. The piston 43 is received within a cylinder 47, while the piston 44 is received in a cylinder 48. The cylinders 47 and 48 have a hydraulic fluid contained therein and are connected to one another via a hydraulic line 50 which has a delay mechanism 51 inserted therein. The cylinders 47 and 48 are also connected to one another via a line 53 which communicates with a one-way ball valve 54 in piston 43 and opens directly through piston 44 into cylinder 48.

When a person pushes on the door 20 in the direction of arrow 60, the arm 35 will rotate in the direction of the arrow 61 opposite the direction of arrow 60 as will the arm 33. Since the arm 37 is rigidly connected to the axle 40, the axle 40 will also tend to rotate in the direction of arrow 61 applying a torque to pinion 41 which transmits that torque via rack 42 to the piston 43. The force on piston 43 compresses the hydraulic fluid in cylinder 47 urging the fluid into line 50 where movement of the fluid to the cylinder 48 is delayed by the delay mechanism 51. Until fluid is released by the delay mechanism 51 the door cannot open because the fluid cannot be displaced from cylinder 47 to cylinder 48. When the delay mechanism 51 opens the line 50, force transmitted by pinion 41 will urge the piston 43 to the right and propel the fluid into chamber 48. Upon closing the door, the pinion 41 will move the rack 42 to the left pressurizing fluid in the cylinder 48 and causing the fluid to flow to the right through line 53 and ball valve 54 into the cylinder 47. This can happen very quickly if desired because valve 54 need not apply any throttling restriction to the fluid flowing through line 53. However, if desired, a throttle can be inserted in line 53 so as to slow or break the door closing in accordance with conventional approaches. Moreover, a spring 61 can be disposed between the delay attachment 30 and the arm 33 in order to normally urge the door closed. The spring can be a conventional coil spring anchored at one end to the delay attachment 30 and anchored at the other end to the axle 40 or perhaps could be a spring disposed between the piston 44 and the end 62 of the cylinder 48 as shown so as to have the delay attachment 30 operate in the manner of a conventional door check and/or closure.

The delay mechanism 51 is similar to the delay mechanism disclosed in the parent application Ser. No. 065,491 filed Aug. 20, 1979, the hydraulic features of which are set forth in more detail in U.S. Patent Application Ser. No. 929,968 filed Aug. 1, 1978, and incorporated herein by reference.

The delay mechanism includes a check delay valve 80 and a normally open valve 81, which is held normally open by a solenoid 85. As long as the solenoid 85 is energized, the normally open valve 81 will be closed forcing the fluid through the check delay valve 80. The check delay valve 80 throttles fluid as it flows around line 50. In the preferred embodiment, this delay is for a period of approximately thirty seconds so that one must push on the bar 26 for a period of thirty seconds before the door 20 opens as long as the solenoid 85 is energized to keep the valve 81 closed. When the valve 81 is opened, then fluid in line 50 will pass through the valve 81 and allow the door to open immediately because the fluid is able to bypass the throttle 80.

The coil 86 of the solenoid 85 is connected at one end to an emergency situation control circuit 100 and at the other end to a timing circuit 101. The emergency situation circuit includes a power supply 102, a central station control panel 103 (which preferably includes switches for de-energizing solenoid 85 remotely), fire boxes 104 and smoke detectors 105. These elements are connected in series with a drop-out relay 106 which includes a manual reset switch 107. If either the fire boxes 104 or smoke detector 105 indicate an emergency condition, the drop-out relay 106 will be opened to cut off power from the power supply 102 to the solenoid 85. The solenoid 85 will then allow normally open valve 81 to open so that the fluid in line 50 need not be throttled by the check delay valve 80 in order to flow to cylinder 48. Accordingly, the door 20 will open immediately if an emergency condition is sensed or if, for any reason, power to the solenoid 85 is interrupted. A manual reset switch 107, which can be located at the central station 103, must be operated in order to reclose the drop-out relay 106. If an emergency condition persists, then the manual reset 107 cannot reset drop-out relay 106. A visual indicator 108 in the form of a light is provided at the central station 103 and perhaps adjacent to the door 20 so as to indicate whether the door is operating in an emergency mode or in a delay mode.

The solenoid 85 is attached to ground through the emitter of a transistor 110 located in timing circuit 101. Normally, the transistor 110 is switched on so as to conduct power from power supply 102 to ground. However, when the transistor 110 is switched off, solenoid 85 is no longer energized and normally open valve 81 will open. The timing circuitry 101 includes a three-to-five second timer 115 which is preferably set at five seconds; a fifteen to thirty second timer 116, which is preferably factory set, and a ten second timer 117, which triggered by the timer 116 to turn off transistor 110 for a period of ten seconds. The timers operate in series and are connected to a microswitch 120 that is operated by an arm 121 which is pressed by spring 122 into engagement with the push bar 26. Upon pressing the push bar 37 toward the door 20, the microswitch 120 is closed which starts the three-second timer 115 and which lights visual indicators 125 which may be at the central station 103 or perhaps at the door 20. The switch 120 also energizes an audio indicator or alarm 126 located adjacent the door 20 so as to indicate to the person trying to open the door and others in the vicinity of the door that the door has been tampered with. If desired, an audio indicator 126 may also be located at the central station 103.

Upon closing the switch 120, the first timer 115 is started and counts a time interval with the duration of five seconds. If the push bar 26 is released before the five second interval expired, then the timer 115 is reset and will start all over again if the bar is thereafter pressed. If the bar 26 is kept pressed for five seconds then the first timer 115 triggers the second timer 116 which runs for a period of fifteen to thirty seconds, the period being determined at the factory or during installation. The timer 116 cannot be stopped or reset after being started. Upon expiration of the time interval (preferably thirty seconds) which interval is programmed into the second timer 116, the second timer triggers the third timer 117 which interrupts power to the base of transistor 110 for an interval of ten seconds. When the transistor 110 is turned off, solenoid 85 will be deenergized and normally open valve 81 will open allowing the door 20 to open immediately. During this ten second interval, the door may be opened and closed without the necessity of waiting for the time sequence. Moreover, after the ten second interval has expired, the door may be held open indefinately, but once the door is allowed to close, the timing sequence must be reinitiated.

The electronic timing system operates in parallel with the hydraulic system so as to provide a fail-safe arrangement so that if the hydraulic system does not operate the electronic system will operate, and if the electronic system 101 fails for some reason the hydraulic system will still allow the door 20 to open. It is emphasized that the combination of the hydraulic system and electrical system provides isolation between the solenoid 85 and the mechanical forces transmitted through the linkage 33 into the delay attachment 30. Accordingly, the system will not jamb due to mechanical forces preventing the emergency soleinid 85 from operating. Since the solenoid 85 merely allows the normally open valve 81 to open, a system with a very quick response is achieved whereby after the selected time interval, the door 20 will open immediately.

It is to be kept in mind that the system will operate without the throttling feature of the delay check valve 80. If, for example, it is desired to have a door securing system in which the securing member does not mechanically move until after the selected or desired time interval has expired, then the fluid in the fluid circuit can be prevented from moving as long as the normally open valve 81 is closed. Immediately upon opening the valve 81, the fluid can move from cylinder 47 to cylinder 48 thereby allowing the door 20 to open.

In the embodiment in which the delay check valve 80 is deleted, the linkage 33 does not move at all after a force is applied to the door. Consequently, the door 20 will remain tightly shut within the door frame 22.

In essence, the delaying attachment 30 is one embodiment of a securing means which prevents the door 20 from opening when in a first mode and allows the door to open when in a second mode. Transition between the first and second modes is effected by expiration of the delay interval provided by the timing circuit 101; by operation of at least one of the components 103, 104 or 105 of the emergency circuit 100, or by throttling enough fluid through the check delay valve 80 to permit the bolt 26 to retract. If an abrupt change is desired after the delay, then the check delay valve 80 can be eliminated as suggested in the previous paragraph.

The foregoing is merely illustrative of the invention which is to be limited only by the following claims.

What is claimed:

1. In a door securing system wherein the door is hinged along one edge to a door frame and is secured by a latch along at least one other edge to the door frame and wherein the latch is operated by a panic bar to unlatch the door; the improvement comprising:

an attachment mounted between the door and door frame for operation in two modes wherein the first mode prevents opening of the door even when the door is unlatched and wherein the second mode permits opening of the door when the door is unlatched; the attachment comprising:

a hydraulic cylinder with a piston mounted therein for displacing fluid from the hydraulic cylinder;

means for driving the piston to displace the fluid from the hydraulic cylinder;

linkage means for connecting the driving means between the door frame and door whereby force on the door is transmitted through to the piston for displacing the piston;

means for delaying transition of the attachment means from the first mode to the second mode wherein the delaying means includes:

electrical switch means for providing a signal indicating that an attempt to open the door is occurring;

timing means started by the signal of the electrical switch means for emitting a trigger signal after a predetermined interval;

means operated by the trigger signal for allowing transition of the attachment means from the first mode to the second mode; the means operated by the trigger signal including a throttle connected to the hydraulic cylinder which throttle permits the fluid to gradually displace from the cylinder; a normally open valve; a solenoid for operating the valve, and a drop-out relay for de-energizing the solenoid wherein the normally open valve is held closed by the solenoid when the solenoid is energized and wherein the solenoid is connected to the timing means via the drop-out relay; whereby when the trigger signal is emitted, the drop-out relay opens, de-energizing the solenoid and allowing the closed normally open valve to open so that the fluid can be displaced and the door opens if pushed; and means for indicating that an attempt has been made to open the door.

2. The system of claim 1 wherein the timing means further includes:

a third timer connected to the second timer for holding the attachment means in the second mode for a predetermined interval and for thereafter permitting the attachment means to return to the first mode.

3. The system of claim 1 wherein the means for signaling when an attempt has been made to open the door is activated directly by the electrical switch means.

4. The system of claim 2 wherein the first timer includes means for delaying the first trigger signal for approximately three seconds, the second timer includes means for delaying the second trigger signal for approximately fifteen to thirty seconds; and the third timing means includes means for delaying the third trigger signal for approximately ten seconds.

5. The system of claim 1 wherein the first timer includes means for delaying the trigger signal for approximately three seconds, and the second timer includes means for delaying the timing signal for approximately fifteen to thirty seconds.

6. The system of claim 1 wherein the timing means includes:

a first timer connected to the electrical switch means for providing a trigger signal after a predetermined delay in order to indicate that a serious attempt to open the door is occurring; and a second timer connected to and started by the trigger signal of the first timer, said second timer emitting a second trigger signal which is the trigger signal which operates the means for allowing transition of the attachment means from the first mode to the second mode.

7. The door securing system of claim 1 further including emergency condition detection means for emitting a signal indicating an emergency condition, said emergency condition detection means being connected to the drop-out relay whereby upon the occurrence of an emergency condition the drop-out relay opens allowing immediate opening of the door.

* * * * *